US010807264B2

(12) United States Patent
Baumgartner et al.

(10) Patent No.: US 10,807,264 B2
(45) Date of Patent: Oct. 20, 2020

(54) MACHINE FOR CUTTING TUBES

(71) Applicant: UNIFLEX-HYDRAULIK GMBH, Karben (DE)

(72) Inventors: Carsten Baumgartner, Laubach (DE); Eduard Weikum, Butzbach (DE)

(73) Assignee: UNIFLEX-HYDRAULIK GMBH, Karben (DE)

( * ) Notice: Subject to any disclaimer, the term of this patent is extended or adjusted under 35 U.S.C. 154(b) by 0 days.

(21) Appl. No.: 16/184,588

(22) Filed: Nov. 8, 2018

(65) Prior Publication Data

US 2019/0077035 A1 Mar. 14, 2019

Related U.S. Application Data

(63) Continuation of application No. PCT/EP2017/061995, filed on May 18, 2017.

(30) Foreign Application Priority Data

May 25, 2016 (DE) ..... 10 2016 109 686

(51) Int. Cl.
*B26D 3/16* (2006.01)
*B26D 7/06* (2006.01)
*B26D 7/01* (2006.01)

(52) U.S. Cl.
CPC ..... *B26D 3/16* (2013.01); *B26D 7/0608* (2013.01); *B26D 2007/013* (2013.01);
(Continued)

(58) Field of Classification Search
CPC ..... B26D 2007/013; B26D 3/10; B26D 3/16; B26D 7/0608; B26D 7/14; Y10T 83/343;
(Continued)

(56) References Cited

U.S. PATENT DOCUMENTS 455,816 A * 7/1891 Hadfield ..... B26D 3/16 82/47
2,925,005 A * 2/1960 Hensley ..... B23D 47/04 83/176

(Continued)

FOREIGN PATENT DOCUMENTS

DE 2425492 A1 * 12/1975 ..... B26D 3/16
DE 8907173 U1 * 10/1989 ..... B23D 47/045

(Continued)

OTHER PUBLICATIONS

EP1787745 English Translation; May 2007; Siemens Kornelius.*

(Continued)

*Primary Examiner* — Laura M Lee
(74) *Attorney, Agent, or Firm* — Myers Wolin, LLC

(57) ABSTRACT

A machine for cutting tubes is provided including a support table, at least two tube rests protruding from the table and arranged at a distance from one another, and a separating device arranged therebetween. The support table has a substantially flat tube-supporting surface, and the separating device has a cutting knife and a tube feed which can move parallel to the separating plane and has two thrust pieces arranged on both sides of the separating plane, each having a tube contact surface. At least one of the thrust pieces has a thrust piece attachment adjustably attached to a carrier and having tube contact surfaces.

8 Claims, 3 Drawing Sheets

(52) U.S. Cl.
CPC ..... *Y10T 83/0596* (2015.04); *Y10T 83/323* (2015.04); *Y10T 83/343* (2015.04); *Y10T 83/8752* (2015.04)

(58) Field of Classification Search
CPC ..... Y10T 83/323; Y10T 83/6657; Y10T 83/6656; Y10T 83/8752; Y10T 83/8758; Y10T 83/66; B27B 25/10
USPC ..... 83/175, 176, 17, 431, 435, 424, 411.4, 83/437.1–437.2, 435.15, 436.2, 566, 567, 83/570, 440; 225/23, 6
See application file for complete search history.

(56) References Cited

U.S. PATENT DOCUMENTS 3,066,564 A * 12/1962 Carpenter ..... B26D 3/16 83/175
3,212,185 A * 10/1965 Keiter ..... B26D 7/0683 29/564
3,232,159 A * 2/1966 Stanley ..... B23D 45/003 83/175
3,253,333 A * 5/1966 Keiter ..... B29D 23/001 29/558
3,683,557 A * 8/1972 Maples ..... B23D 45/003 451/129
3,863,538 A * 2/1975 Behnke ..... B26D 1/0006 83/676
4,567,795 A * 2/1986 Pool ..... B23D 45/10 83/17
5,253,558 A * 10/1993 Guddal, Jr. ..... B26D 1/0006 83/175
8,261,646 B2 * 9/2012 De Matteis ..... B23D 47/04 225/2
2013/0186246 A1 * 7/2013 Franze ..... B26D 1/06 83/452

FOREIGN PATENT DOCUMENTS

EP 1787745 A1 * 5/2007 ..... B23D 45/12
GB 1505113 A 3/1978
JP 5541204 U 3/1980
JP 5514204 B2 * 6/2014

OTHER PUBLICATIONS

DE-2425492-A1 English Translation; Dec. 1975 Heckhausen Hans.*
DE8907173-U1 English translation; Eyer et al.*
JP-5514204-B2 English Translation; Jun. 2014.*
International Search Report issued for International Patent Application No. PCT/EP2017/061665 dated Jul. 20, 2017.

* cited by examiner

MACHINE FOR CUTTING TUBES

CROSS REFERENCE TO RELATED APPLICATIONS

This application is a continuation under 35 U.S.C. § 120 of International Application PCT/EP2017/061995, filed May 18, 2017, which claims priority to German Application No. 10 2016 109 686.5, filed May 25, 2016, the contents of each of which are incorporated by reference herein.

FIELD OF THE INVENTION

The present invention relates to a machine for cutting hoses, comprising a support table, at least two hose rests protruding therefrom and spaced apart from one another, and a cutting device disposed between them, wherein the support table has a substantially plane hose support face and the cutting device comprises a cutting blade, which extends in a cutting plane disposed substantially perpendicular to the hose support face, as well as a hose feed, movable parallel to the cutting plane, with two thrust pieces disposed on both sides of the cutting plane with one hose contact face each.

BACKGROUND

Machines of the type indicated in the foregoing, so-called "hose-cutting machines," are known (for example from GB 1505113) and in practical service. They are used in particular for cutting hose portions to length from a hose supply, for example prior to further processing of the hose portion in question for production of a product comprising it.

In the case of manufacture of lines for hydraulic applications, in which connecting fittings are pressed in end position onto the hose portion in question, very stringent requirements are applicable—especially in the case of high-pressure applications—to the quality of the separating cut, and are so specifically both with regard to the geometry of the cut profile (exactly perpendicular to the axis of the hose) and with regard to the neatness of the cut (e.g. no jagged edges). This is so because such deviations from the ideal cut profile result potentially in reduced reliability of the hydraulic line in question, failure of which may certainly have serious consequences in the individual case. Production of ideal separating cuts is made particularly difficult by the fact that the manufacture of hoses used for hydraulic lines are regularly reinforced with an inlay (e.g. of braided steel wire), so that extremely different materials (rubber on the one hand and steel wire on the other) must be completely severed neatly with a single separating cut.

In practice, unsatisfactory deviations from ideal execution of the separating cut have occurred in the past—even during use of ultra-modern hose-cutting machines—during the cutting of hoses used in the manufacture of hydraulic lines. Accordingly, the present invention is oriented toward remedying this disadvantage. In particular, the intention is to provide a hose-cutting machine of the class in question, improved compared with the prior art, wherein improved results can be achieved during the use thereof for cutting of standard hoses intended for hydraulic applications.

SUMMARY

The present object is achieved according to the present invention by the fact that, in a machine mentioned in the introduction for cutting hoses, at least one first of the thrust pieces is provided with a thrust-piece attachment affixed positionably on a carrier and provided with the associated hose contact face. Taking advantage of this, the present invention is based on the entirely surprising fact that, by means of positioning (at least) of one of the thrust pieces of the hose feed in such a way that the two hose contact faces do not lie for a long distance in a common plane perpendicular to the cutting plane, the result of cutting of the hose can be improved in the sense of a cut structure that approximates the ideal condition. As the inventors have ascertained, it is possible, by selective asymmetry of the two hose contact faces relative to the cutting plane, in a manner matched to the individual application situation—particular hose (inside diameter, outside diameter, base material, reinforcing material) and particular cutting blade (thickness, diameter, cutting-teeth geometry)—to correct or compensate for a deviation of the separating cut from the ideal condition during use of conventional hose-cutting machines.

According to a first preferred further development of the invention, the positionability of the thrust-piece attachment comprises at least an ability to change the angular position of the hose contact face relative to the hose support face. With this angular positionability of the thrust-piece attachment of the first thrust piece relative to the hose support face, relative angular positioning of the two hose contact faces relative to one another is achieved, so that these—as the result of appropriate positioning—are oriented in skewed manner relative to one another. In a particularly preferred further development, the thrust-piece attachment of this first thrust piece may be positionable on the carrier by the fact that it can be pivoted around an axis disposed substantially parallel to the hose support face and perpendicular to the cutting plane.

Another preferred further development of the invention is characterized in that the positionability of the thrust-piece attachment associated with the first thrust piece comprises its parallel displacement on the carrier to generate a parallel offset of the two hose support faces relative to one another. In this sense, for example, the thrust-piece attachment may be guided such that it can be displaced in parallel manner in a corresponding receptacle or pocket made in the carrier of the corresponding thrust piece. The axis of this said displacement movement may run parallel to the hose support face. In a preferred further development, however, it includes an angle with the hose support face. This is the case in particular when the hose contact faces for their part are not directed perpendicularly relative to the hose support face but instead include therewith an angle deviating from 90°. According to yet another preferred further development, the axis of this said displacement movement may be directed perpendicularly relative to the orientation of the hose contact face of the pressure-piece attachment in question. However, this is not absolutely necessary.

The possibilities explained in the foregoing for optimizing the positioning of the two hose contact faces relative to one another and to the cutting blade with regard to the individual application are particularly obvious when the thrust-piece attachment of the first thrust piece can be both pivotable and displaceable in parallel manner relative to the associated carrier, so that mounting of the thrust-piece attachment of the first thrust piece on the carrier in question in a manner that permits both positioning capabilities is provided particularly preferably.

A comparably favorable result can be achieved when the second thrust piece of the hose feed also comprises a carrier and a thrust-piece attachment affixed positionably thereon and provided with the associated hose support face, wherein (at least) parallel displaceability of the thrust-piece attachment in question is provided for one of the two thrust pieces and (at least) angular displaceability of the thrust-piece attachment in question is provided for the other thrust piece.

According to yet another preferred further development of the present invention, the hose feed comprises a one-piece feed block, on which the carrier of the first thrust piece and the second thrust piece or its carrier are constructed. This is favorable with regard to the absolutely synchronized feed of both thrust pieces during cutting of a hose and the application of force necessary for this purpose.

In an alternative construction of the present invention, it is provided that a hose feed that is movable parallel to the cutting plane comprises a feed block on which two thrust pieces disposed on both sides of the cutting plane are designed with one hose contact face each, wherein the feed block is mounted positionably in such a way that the orientation of the two hose contact faces relative to the cutting plane is variable. In this alternative to the configurations explained in the foregoing, a substantially identical result can be achieved at least partly, namely by the fact that the two hose contact faces are not necessarily disposed symmetrically relative to the cutting plane but instead may optionally be adjusted more or less asymmetrically relative thereto, in the sense that one of the two thrust pieces leads the other more or less noticeably in feed direction of the hose feed. For this purpose, the feed block may be mounted with the ability to rotate, especially relative to a pivot axis, for example directed substantially perpendicularly relative to the hose support face.

Regardless of the specific configuration of the present invention, i.e. regardless of the respective specifically realized positionability, scaling proves to be expedient, by means of which the respective individual adjustment of the hose feed is reproducible.

BRIEF DESCRIPTION OF THE DRAWING

The present invention will be explained in more detail hereinafter on the basis of several preferred exemplary embodiments illustrated in the drawing, wherein.

DETAILED DESCRIPTION OF THE PREFERRED EMBODIMENTS

Figure 1:
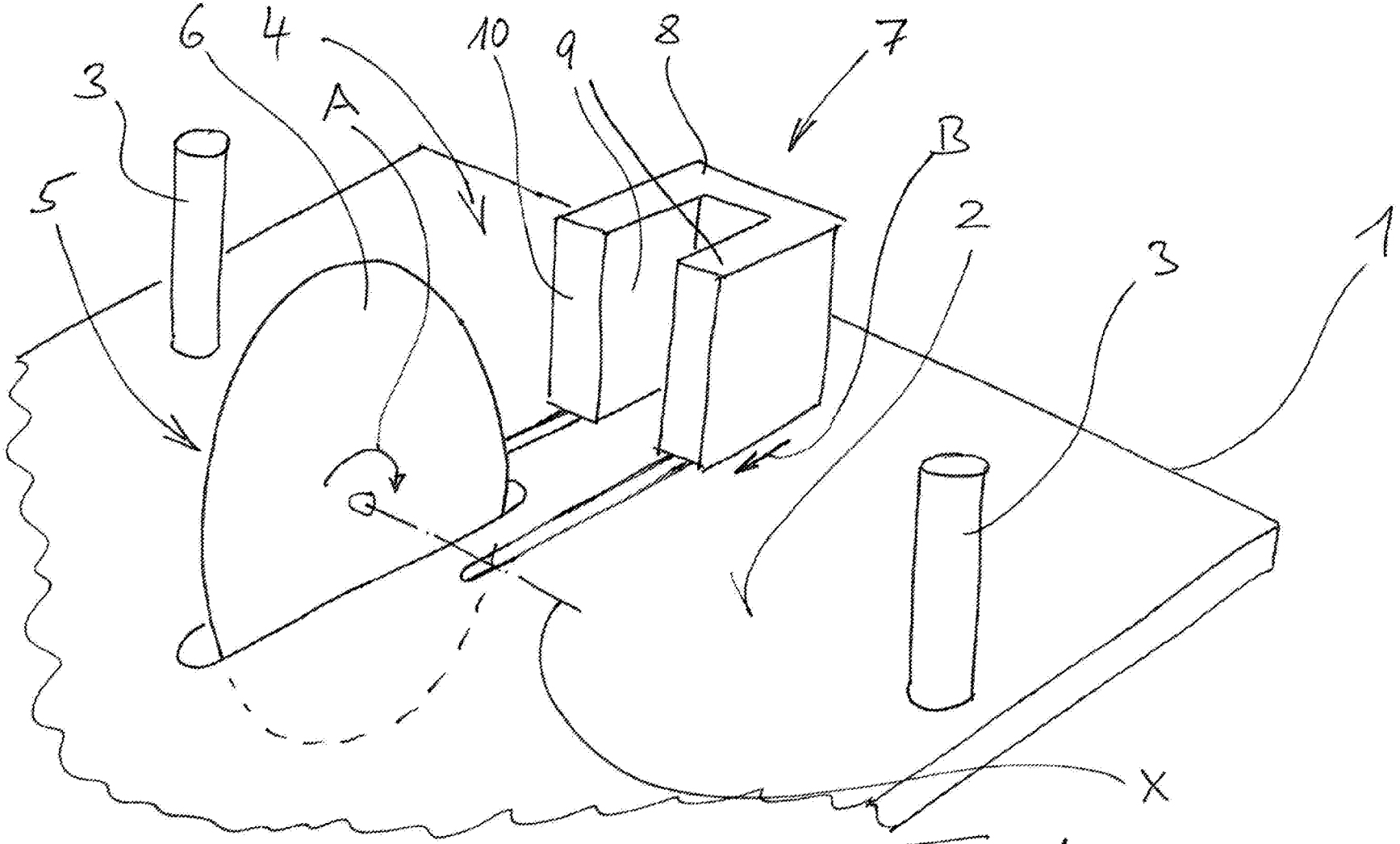
Fig. 1 PRIOR ART
FIG. 1 shows, in a perspective schematic diagram, the configuration features essential here for a hose-cutting machine corresponding to the prior art.

The machine for cutting hoses, schematically illustrated in FIG. 1, comprises, as is known from the prior art (see, for example, GB 1505113) and therefore needs no more detailed explanation, a support table 1 with a substantially plane hose support face 2, two hose rests 3 protruding therefrom and spaced apart from one another, and a cutting device 4 disposed between them. The latter comprises a cutting blade 5 in the form of a cutting wheel 6, which is driven in rotating manner (arrow A) around an axis X that is substantially parallel to hose support face 2, and which defines a cutting plane directed substantially perpendicularly relative to hose support face 2. Furthermore, cutting device 4 comprises a hose feed 7, which is movable (arrow B)—by means of a feed mechanism, not shown, disposed underneath support table 1—parallel to the cutting plane as well as parallel to hose support face 2. This is provided with two thrust pieces 9, each having a hose contact face 10, disposed on both sides of the cutting plane, constituting part of a one-piece feed block 8, which is substantially U-shaped in horizontal section. Hose feed 7 brings about feed motion and increasing deflection of the hose to be cut, bearing on the two hose rests 3.

Figure 2:
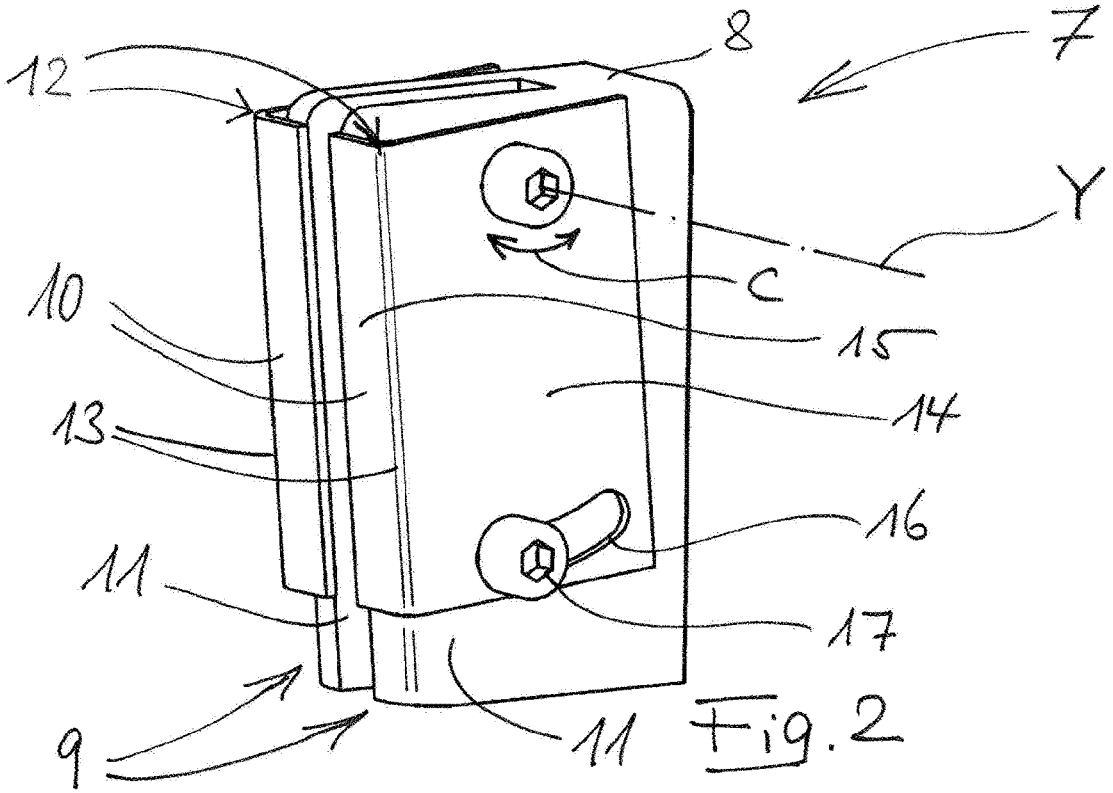
FIG. 2 shows, in perspective view, the part of the hose feed that is decisive here in a first embodiment of an inventive hose-cutting machine.

Building on this basic configuration of the hose-cutting machine, the exemplary embodiment of the invention shown in FIG. 2 is characterized by the specific configuration of hose feed 7 explained hereinafter. Its thrust pieces 9 are of multi-piece type, in the sense that they respectively consist of a carrier 11 and a thrust-piece attachment 12 affixed positionably thereon and provided with the associated hose contact face 10. These thrust-piece attachments 12 are respectively constructed as a substantially L-shaped sheet-metal part 13 with a long branch 14 and a short branch 15, placed externally on the associated carrier 11. In the region of its long branch 14, the respective thrust-piece attachment 12 is mounted on the associated carrier 11 so as to be pivotable (arrow C) around an axis Y disposed substantially parallel to hose support face 2 and substantially perpendicular to the cutting plane. Hereby it is possible to adjust the angle that the hose contact face 10 defined by short branch 15 of thrust-piece attachment 12 assumes relative to hose support face 2. A clamping screw 17 cooperating with an arc-shaped elongated hole 16 is used for fixation of the adjusted position.

Figure 3:
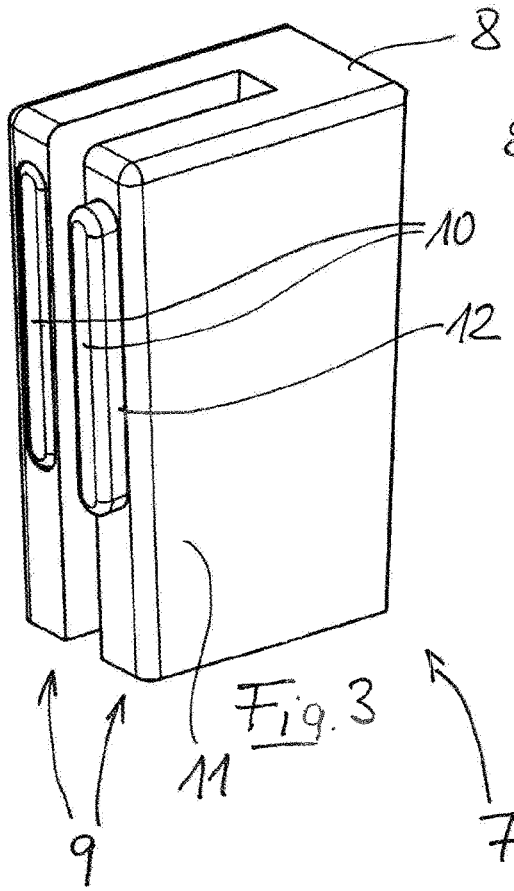
FIG. 3 shows, in perspective view, the part of the hose feed that is decisive here in a second embodiment of an inventive hose-cutting machine
Figure 4:
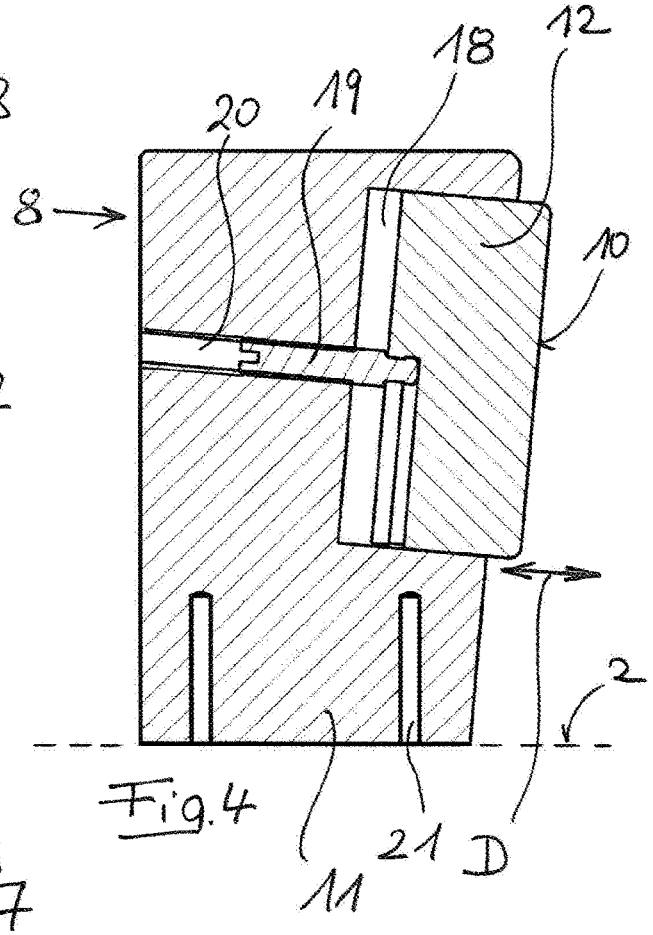
FIG. 4 shows a section through the part, shown in FIG. 3, of the second embodiment of the hose-cutting machine according to the invention.

In the second exemplary embodiment illustrated in FIGS. 3 and 4, the two thrust pieces 9 of hose feed 7 are also of multi-piece type, in the sense that they respectively consist of a carrier 11 and a thrust-piece attachment 12 affixed positionably thereon and provided with the associated hose contact face 10. However, the positionability of thrust-piece attachments 12 is provided in this case in the form of their parallel displacement (arrow D) on the respective carrier 11. Thus a parallel offset of the two hose support faces 10 relative to one another can be adjusted.

For this purpose, in order to receive a substantially rectangular thrust-piece attachment 12, each of the two carriers 11 is provided with a corresponding pocket 18, open toward the end face of carrier 11. Thrust-piece attachment 12 protrudes out of the associated carrier 11, wherein the extent by which it protrudes can be positioned. For this purpose, a positioning screw 19 is provided, which is fixed at its end on thrust-piece attachment 12 by rotation around a fixed axis, wherein it cooperates with a thread 20 constructed in carrier 11.

In FIGS. 3 and 4, it is obvious that the inclination of hose contact faces 10 relative to hose support face 2 differs from 90°. The axis of parallel displaceability of thrust-piece attachments 12 then runs perpendicular to the orientation of the respective hose contact face 10. Furthermore, threaded bores 21 used to join feed block 8 with a feed mechanism disposed underneath the support table (see FIG. 1) are visible in FIG. 4.

Merely for the sake of completeness, it must be pointed out that a combination of the two illustrated positioning capabilities in a single hose feed is possible, by constructing one of the thrust pieces according to FIG. 2 and the other according to FIGS. 3 and 4.

Figure 5:
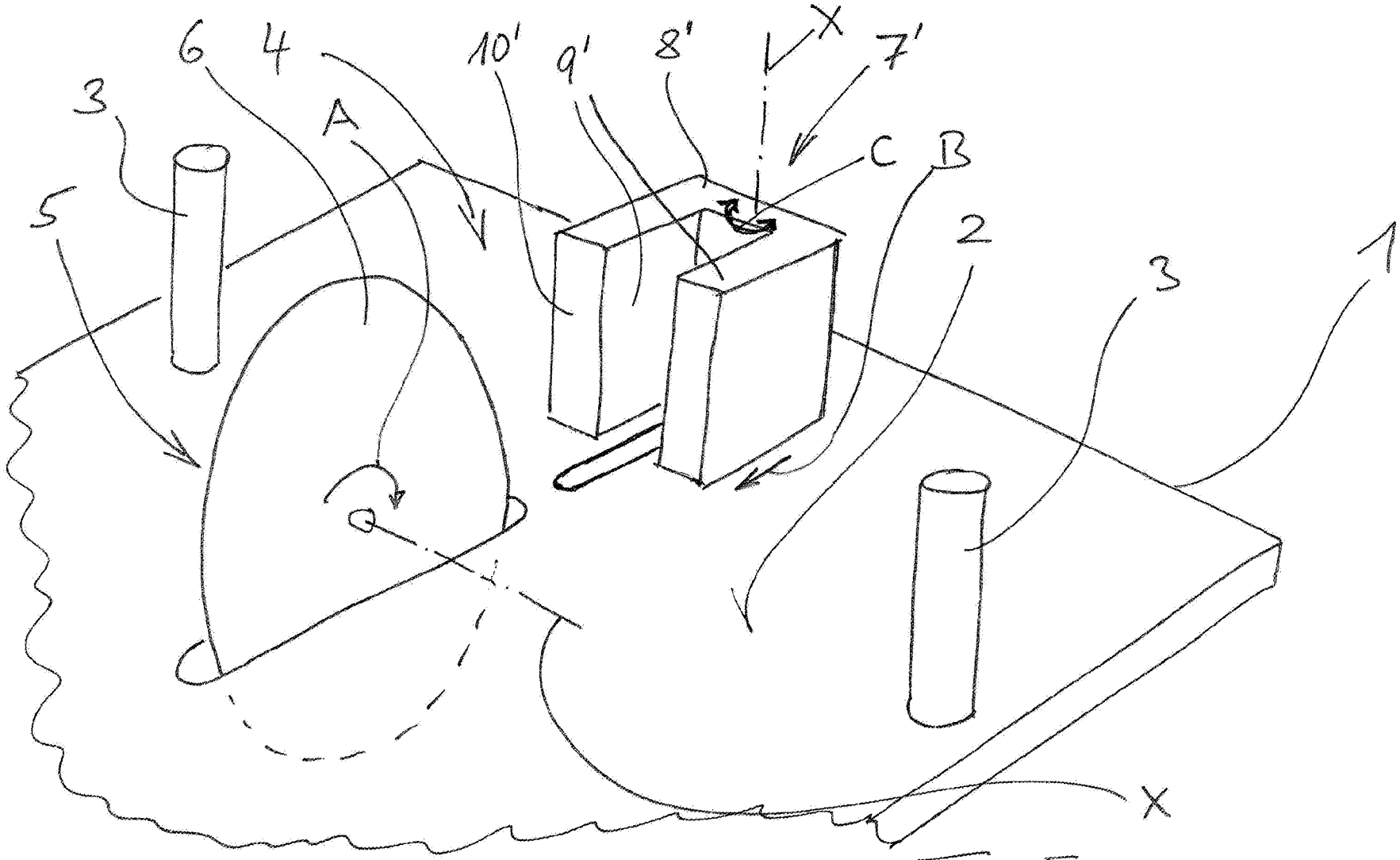
FIG. 5 schematically illustrates a second alternative implementation of the present invention.

According to FIG. 5, which illustrates an alternative form of implementation of the present invention, hose feed 7', which is movable parallel to the cutting plane (arrow B), comprises a feed block 8', on which two thrust pieces 9' disposed on both sides of the cutting plane are designed with one hose contact face 10' each. This feed block 8' is positionable in such a way, namely is mounted such that it can be rotated (arrow C) by a defined extent (e.g. +/−5°) around pivot axis X, which is directed substantially perpendicularly relative to hose support face 2, that the orientation of the two hose contact faces 10 is variable relative to the separating plane. Depending on the specifically adjusted angular position of feed block 8', one of the two thrust pieces 9' together with the associated hose contact face 10' leads or lags the other thrust piece 9' more or less noticeably in feed direction B of hose feed 7'. It is then possible, by suitable mounting of feed block 8', to compensate for a lateral offset—induced by rotation of feed block 8' around axis X—of the two hose contact faces 10' relative to the cutting plane.

In other respects, the embodiment according to FIG. 5 can be understood directly from the foregoing explanations of the invention, and so no further descriptions are needed.

What is claimed is:

1. A machine for cutting hoses, comprising a support table (1), at least two hose rests (3) protruding therefrom and spaced apart from one another, and a cutting device (4) disposed between them, wherein the support table (1) is at a fixed location relative to a cutting blade (5) of the cutting device and has a substantially planar hose support face (2) and the cutting device (4) comprises the cutting blade (5), which extends in a cutting plane disposed substantially perpendicular to the hose support face (2), as well as a hose feed (7), movable parallel to the cutting plane, with two thrust pieces (9) disposed on both sides of the cutting plane with one hose contact face (10) each, wherein at least one of the two thrust pieces (9) comprises a thrust-piece attachment (12) and a carrier (11), the thrust-piece attachment affixed positionably on the carrier (11) and provided with the associated hose contact face (10), and wherein the two thrust pieces are movable parallel to the substantially planar hose support face of the support table.

2. The machine of claim 1, wherein the positionability of the thrust-piece attachment (12) comprises at least an ability to change the angular position of the hose contact face (10) relative to the hose support face (2).

3. The machine of claim 2, wherein the thrust-piece attachment (12) is positionable on the carrier (11) by the fact that it can be pivoted around an axis (Y) directed substantially parallel to the hose support face (2) and substantially perpendicular to the cutting plane.

4. The machine of claim 1, wherein the positionability of the thrust-piece attachment (12) comprises the parallel displacement of the thrust-piece attachment on the carrier (11) to generate an offset of the two hose contact faces (10) relative to one another.

5. The machine of claim 1, wherein the second thrust piece (12) comprises a carrier (11) and a thrust-piece attachment (12) affixed positionably thereon and provided with the associated hose support face (10).

6. The machine of claim 1, wherein the hose feed (7) comprises a one-piece feed block (8), wherein the carrier (11) of the first thrust piece and the second thrust piece (9) or a carrier (11) of the second thrust piece are constructed as components of the one-piece feed block.

7. A machine for cutting hoses, comprising a support table (1), at least two hose rests (3) protruding therefrom and spaced apart from one another, and a cutting device (4) disposed between them, wherein the support table (1) is at a fixed location relative to a cutting blade (5) of the cutting device and has a substantially planar hose support face (2) and the cutting device (4) comprises the cutting blade (5), which extends in a cutting plane disposed substantially perpendicular to the hose support face (2), as well as a hose feed (7'), movable parallel to the cutting plane, with a feed block (8'), on which two thrust pieces (9') disposed on both sides of the cutting plane, with one hose contact face (10') each are formed, wherein the feed block (8') is positionably mounted in such a way that the orientation of the two hose contact faces (10') relative to the cutting plane is variable, wherein the feed block (8') is mounted such that it can be rotated to a pivot axis (X), and wherein the two thrust pieces are movable parallel to the substantially planar hose support face of the support table.

8. The machine of claim 7, wherein the pivot axis (X) is disposed substantially perpendicular to the hose support face (2).

* * * * *